US005481246A

United States Patent [19]

Seravalli et al.

[11] Patent Number: 5,481,246

[45] Date of Patent: Jan. 2, 1996

[54] ALARM DEVICE HAVING A PICK-UP FORMED AS A CONDENSER WITH PIEZOELECTRIC DIELECTRIC

[75] Inventors: Alessandro Seravalli, Moutier, Switzerland; Henri Moniere, Herblay, France

[73] Assignee: Verres Industries SA, Moutier, Switzerland

[21] Appl. No.: 390,829

[22] Filed: Feb. 17, 1995

Related U.S. Application Data

[63] Continuation of Ser. No. 25,186, Mar. 2, 1993, abandoned.

[30] Foreign Application Priority Data

Mar. 12, 1992 [CH] Switzerland ..... 799/92

[51] Int. Cl.[6] ..... G08B 13/00

[52] U.S. Cl. ..... 340/550; 340/566

[58] Field of Search ..... 340/550, 566, 340/565, 561–564, 545, 541, 511, 429; 310/311, 328, 321, 348, 370

[56] References Cited

U.S. PATENT DOCUMENTS

| | | | |
|---|---|---|---|
| 3,582,692 | 6/1971 | Palini | 340/566 X |
| 4,054,867 | 10/1977 | Owens | 340/550 |
| 4,072,936 | 2/1978 | Spirig | 340/566 |
| 4,495,434 | 1/1985 | Diepers et al. | 310/338 |
| 4,884,061 | 11/1989 | Genevois | 340/550 |
| 4,888,581 | 12/1989 | Guscott | 340/666 |

FOREIGN PATENT DOCUMENTS

| | | | |
|---|---|---|---|
| 0061359 | 9/1982 | European Pat. Off. . | |
| 2171232 | 8/1986 | United Kingdom | 340/550 |
| 2222255 | 2/1990 | United Kingdom . | |

*Primary Examiner*—Brent Swarthout
*Assistant Examiner*—Thomas J. Mullen, Jr.
*Attorney, Agent, or Firm*—Ladas & Parry

[57] ABSTRACT

The device comprises a flat and elongated condenser with a piezoelectric dielectric material placed between two electrodes. This condenser is fastened to a barrier surface such as the glass pane of a display, a cupboard, or a glass window of a protected space. The condenser is connected with an electrometric amplifier, the signals of which are transmitted to an electronic alarm unit. When the glass pane is subjected to shocks or to mechanical stresses due to an attempted break-in, the condenser will generate electrical signals able to trigger an alarm when they exceed a certain threshold. The condenser and the amplifier may also be adjusted so as to trigger an alarm when the electrical field is modified by the movements of a dielectrical body within the protected region.

15 Claims, 5 Drawing Sheets

ALARM DEVICE HAVING A PICK-UP FORMED AS A CONDENSER WITH PIEZOELECTRIC DIELECTRIC

This is a continuation of application Ser. No. 08/025,186 filed on Mar. 2, 1993, abandoned.

BACKGROUND OF THE INVENTION

1. Field of the Invention

The invention relates to an alarm device for monitoring a space which is bounded at least on one side by a glass pane, a wall or any other boundary surface which will be referred to as a "barrier" hereafter. There exist many devices of this type, most of which trigger an alarm when an electrical circuit is interrupted, due to the breakage of the barrier.

2. Description of the Prior Art

This applies for instance to many protection systems for glass panes which comprise wires or a continuous conductive layer, and also to systems which use a so-called "spider" which is generally located in a corner of the pane.

These systems, also in general use, have a number of drawbacks such as:

- the alarm is only triggered when the pane is broken because only this can modify the electrical characteristics of the monitoring circuit; in order to obtain this spider, one must use a thermally tempered glass, which entails optical disadvantages (insufficiently plane surface) and also an immediate and total crumbling of the tempered glass pane,
- there is no alarm when the frame rather than the pane is attacked, so that an aperture could be created by removing the glass pane from its frame,
- the wires can be seen and may hence in certain cases spoil the appearance and be aesthetically displeasing.

SUMMARY OF THE INVENTION

Hence, it is a general object of the present invention to create an alarm device which avoids these drawbacks and which can be used both in order to detect stresses due to an attack on a pane when a theft is intended, and also the moving or removing of objects which are placed near the pane.

When compared with the above mentioned known devices, the invention has the following advantages with regard to the detection of a break-in or an intended break-in:

- it can trigger an alarm for a predetermined level of attack even if the pane is not broken at the first impact; this can become important when firearms are fired on a window pane because in this case an alarm will be triggered upon the very first impact, whether it destroys the pane or not;
- the alarm is also triggered when significant forces are exerted on the frame or when the circuit leading to the alarm center is broken;
- the device comprises no part which is either visible or impairs visibility, and it can be adapted both to single panes and to insulating panes (with two or more plies) because the pick-up can be embodied in the shape of a comparatively flat ribbon which can be easily fastened along the periphery of a protective surface such as a glass pane. The pick-up which is affixed to the pane is constructed so as to react efficiently and electrically either when any point of the pane is subjected to a sudden mechanical stress, or when the electrical field in the vicinity of the pane is modified. Due to its very construction, the device has no inertia but still it is passive and stable (no timedrift). Its linear shape and its small thickness enable it to be easily adapted to any type of pane without the necessity to essentially change the manufacturing process of the same.

In contradistinction to known devices, the device according to the invention may be used as an approach detector in order to prevent the manipulation or the theft of objects which are placed near the barrier, such as for instance when the latter is a glass shelf on which said objects are placed.

BRIEF DESCRIPTION OF THE DRAWING

The invention will now be illustrated in more details through the description of embodiments and with the help of the drawing, in which.

DESCRIPTION OF THE PREFERRED EMBODIMENTS

In order to simplify the description, the space which must be monitored by the described embodiments is always partially bounded by a glass surface, but it must be stressed that the invention can also be applied to other materials, whether transparent or not, in particular when the invention is used as an approach detector.

Figure 1:
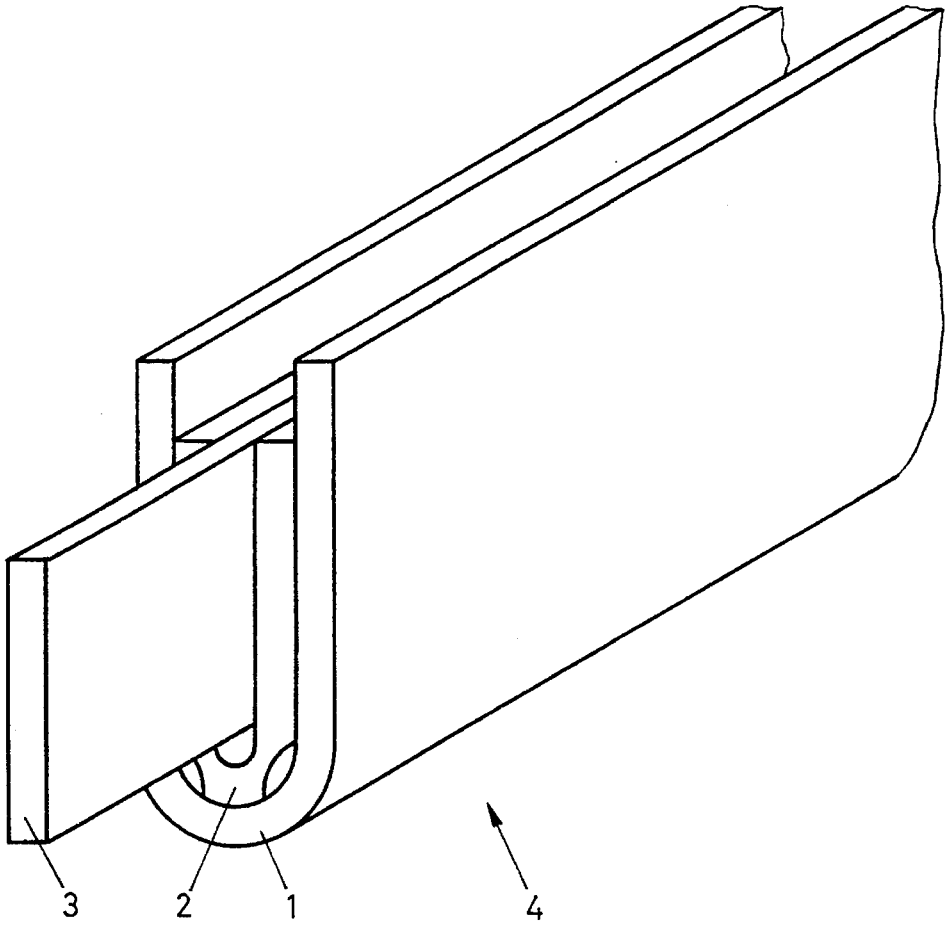
FIG. 1 schematically represents a preferred embodiment of the pick-up.

The pick-up 4 shown in FIG. 1 is a flat and elongated condenser, the dielectric of which is a material that has a strong piezoelectrical effect, such as for example certain synthetic polymers. The pick-up 4 comprises an external electrode 1 which is shaped as a flat U, in which is placed a dielectric material 2 and a central electrode 3.

Figure 2A:
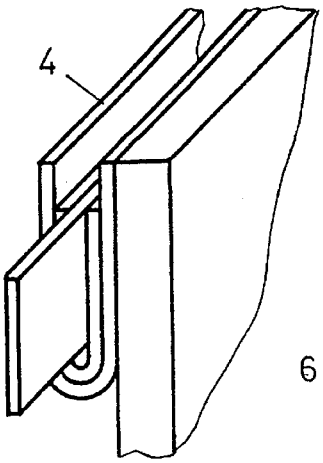
FIGS. 2*a*–2*e* show different ways of fastening the pick-up to a single or multiple-ply pane.
Figure 2B:
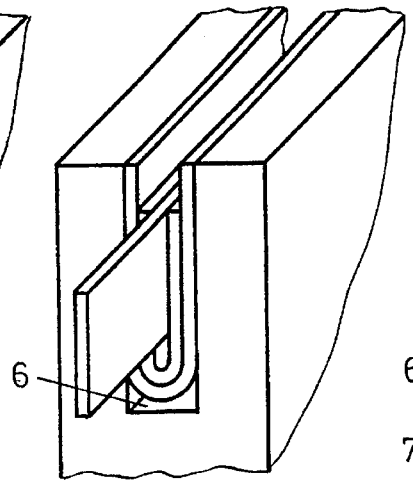
Figure 2C:
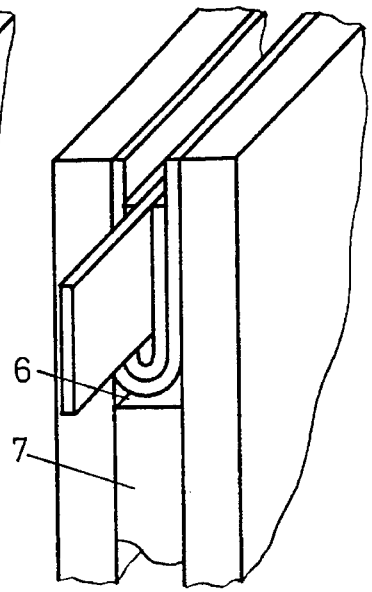
Figure 2D:
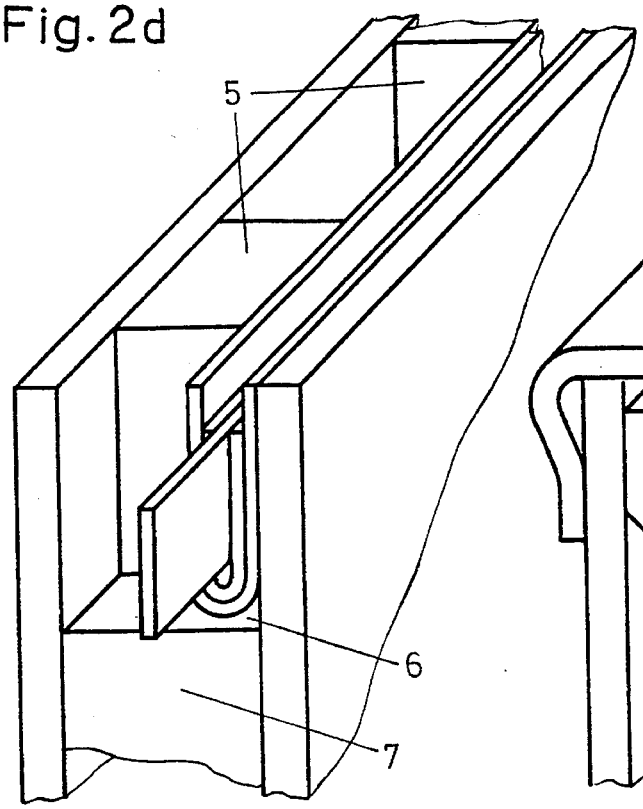
Figure 2E:
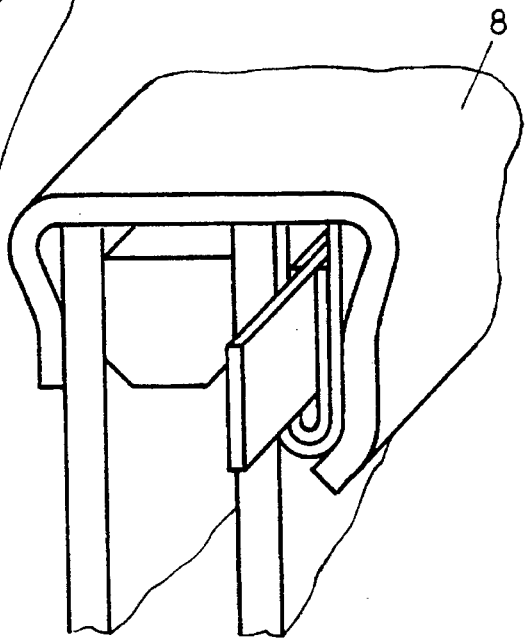

FIGS. 2*a*–2*e* show several ways to fasten a pick-up of the type shown in FIG. 1 to a single pane (FIGS. 2*a* and *b*), to a multi-ply pane (FIGS. 2*c* and *d*), or to an insulating pane (FIG. 2*e*). As can be seen in FIG. 2, the pick-up 4 can be glued onto the inner surface of the pane, preferably along its border (mode a), or introduced in a groove 6 provided in the edge of a single-ply pane (mode b) or in an inner cavity of a multi-ply pane which is glued together with a PVB or other resin 7 (mode c). If the inner space is particularly wide, the pick-up will be immobilized by blocks 5 (mode d). In certain cases, particularly for insulating glass, it may be advantageous to fasten the pick-up to the pane by means of a clamp 8 (mode e). Of course, other types of fastening may be considered, according to circumstances. However, if the first aim is a protection of the pane against a break-in, the condenser will be generally fastened rigidly near one or several rims of the pane, and the open side of the U will be oriented outwards. The fastening of the pick-up to the pane, by gluing and/or mechanical means, will be done in such a way that the pick-up reacts when the pane is subjected to a sudden stress in any of its points. For very large glass panes (of the order of 4 meters and more), it is advantageous to use two pick-ups which are placed along the two vertical rims of the pane and which are connected by a coaxial cable of low capacity, as explained hereafter.

In order to obtain a particularly efficient detection, and also to ensure that all points of the glass pane have the same sensitivity with regard to an attack, and thus to allow a precise adjustment, it is best to use long pick-ups which extend practically along the entire height of the glass pane. This vertical orientation of the pick-up has the further advantage that it becomes practically insensitive even to large vibrations of the ground, such as are induced by railways and heavy trucks.

The pick-up is electrically connected to a probe comprising the electronic circuits which are necessary for preprocessing the signals emitted by the pick-up.

Figure 3:
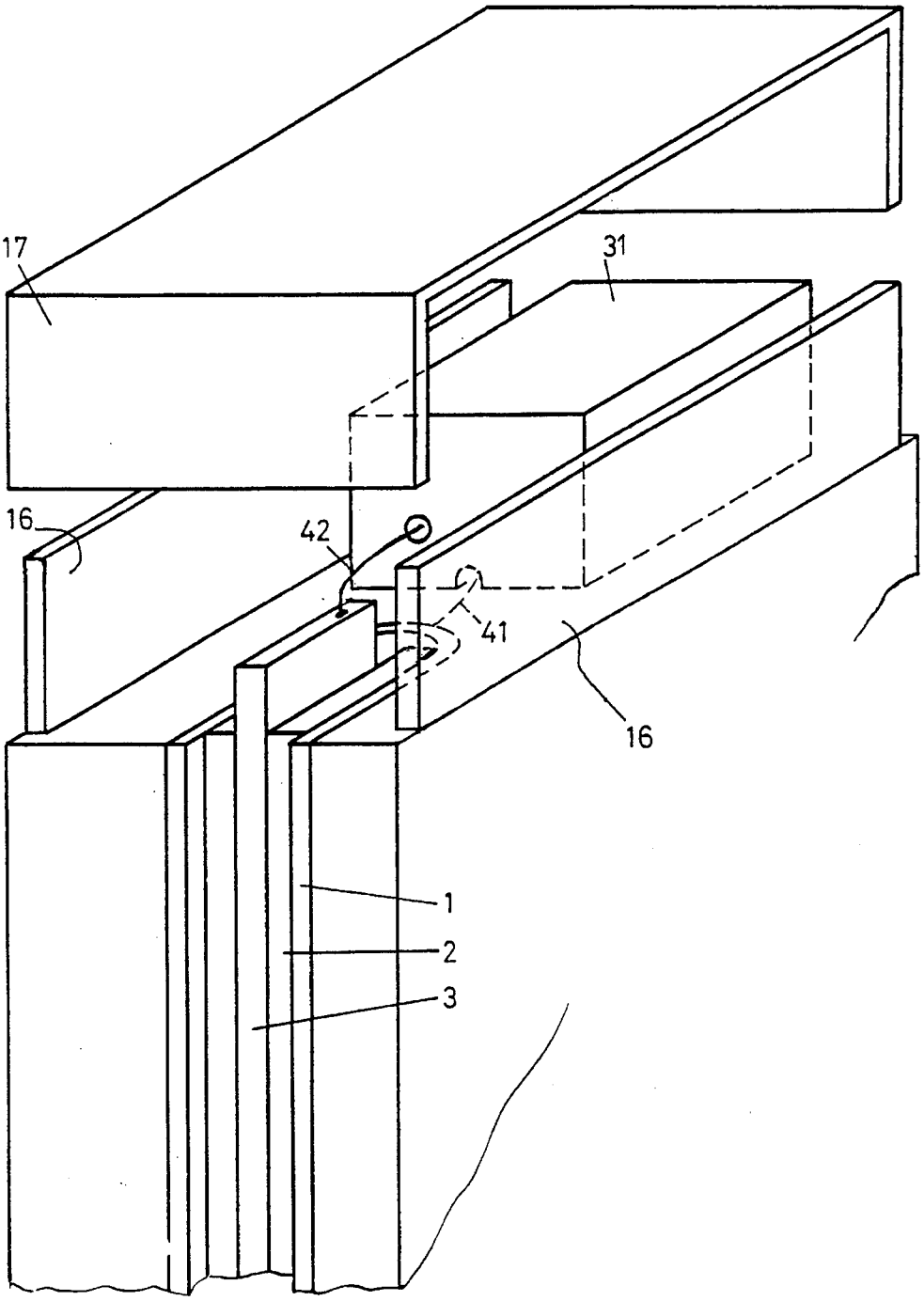
FIG. 3 shows in more detail an embodiment similar to that of FIG. 2*b;*

FIG. 3 shows a preferred position of a probe 31, at the upper part of a window pane and near one end of the condenser 1–3, with which it can thus be connected by very short leads 41, 42, which may be shielded or not. The probe 13 is an electrometric input amplifier which has a small size and will preferably be fastened (glued) to the assembly formed by the pane and the pick-up, at-the top of the pane in order to avoid any unexpected movement of the probe relative to the pick-up. The probe is placed in a separate casing 16 with a lid 17 so as to obtain an electrical shielding of the assembly of pick-up-connection-probe hereinafter referred to as a sensing assembly. If two pick-ups are connected in parallel, they will be connected electrically through a coaxial cable of small capacity, which is also glued to the edge of the pane (not shown in the drawing).

The fastening of the probe and of its casing at the top of the pane is desirable in order to eliminate a possible undesirable effect of deformable connections between these elements. However, this is not necessary; one can thus also place the probe in the frame of the pane or on a wall, and the connection between the pick-up and the probe will then be realized by a coaxial cable.

Figure 4:
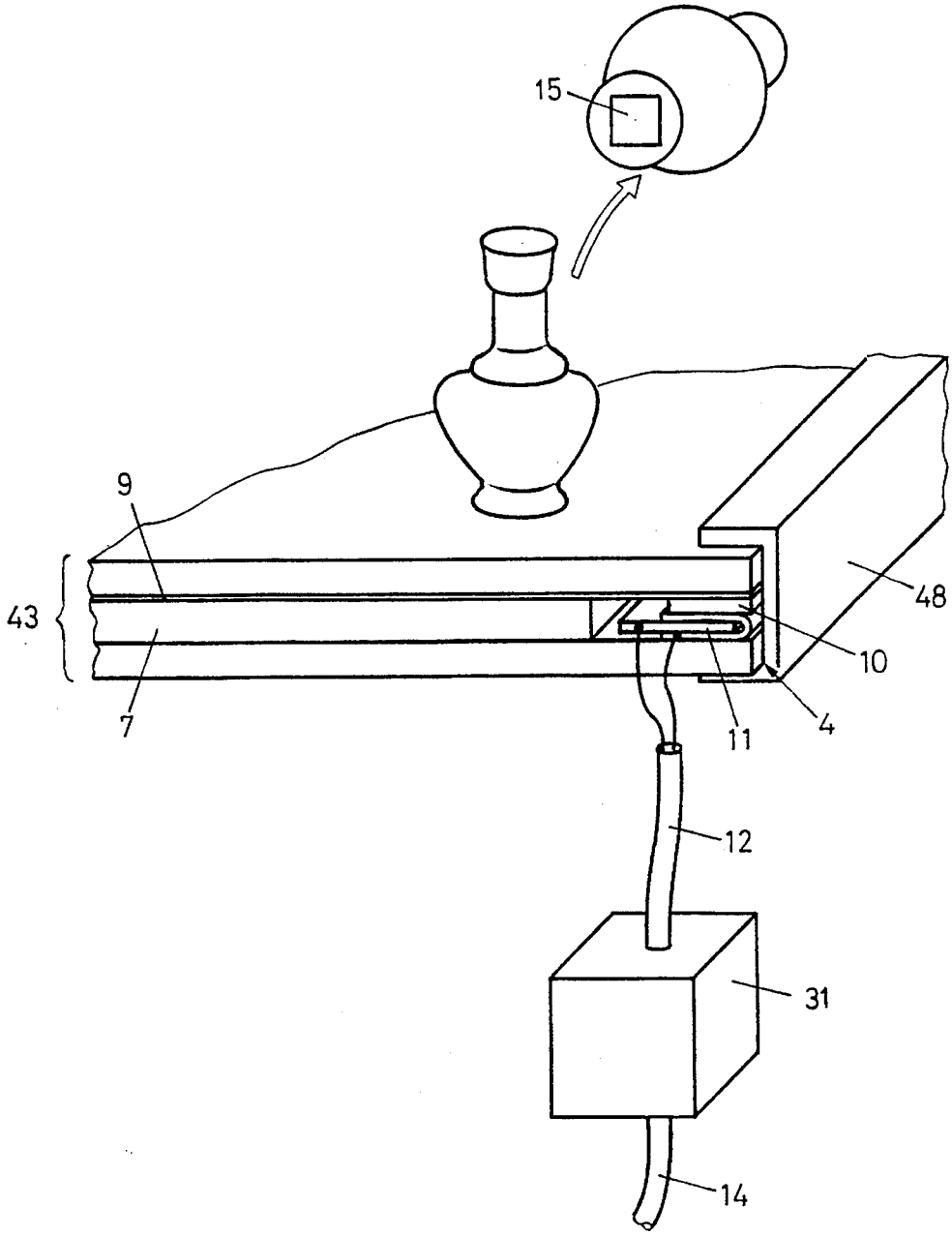
FIG. 4 schematically shows an embodiment which is more particularly intended to detect approach and movement.

FIG. 4 shows an embodiment which is more particularly meant to detect an approach, a passage, a contact, a manipulation or a theft in a region situated above a multi-layered glass pane 43, essentially without exerting any mechanical effort on this pane. In this case the detector works through electrical influence, or in other words through electrostatic destabilization. This is obtained by the aid of a collector which is formed by a conductive surface 9 deposited on the internal face of the upper glass pane. The pick-up is placed on an insulating layer 10 and its protruding central electrode 11 provides a light capacitive coupling with the collector.

It will be noted that the central electrode of the condenser 4 is now oriented towards the inner side of the pane, which means that the orientation of the condenser is the reverse of that shown in FIGS. 2*a*–2*e*, in particular in FIG. 2*c*, where the pick-up is also placed in the interior of a multi-layer pane. In order to detect an approach or a passage, it is advantageous to surround the pane with a dielectric frame, for instance made of PVC, in order to improve the homogeneity of the electrical field in the considered region. For better clarity of the drawing, a U-shaped profile 48 which is able to form such a frame has been illustrated schematically, on a single side of the pane shown in FIG. 4. In order to detect a manipulation or a theft such as is more particularly shown in FIG. 4, the pane may also be used "naked", that is to say without a frame. Depending on the material of the monitored object, it may be useful to attach a layer of dielectric material to its lower surface. A thin and transparent, self-sticking label 15 made of PVC may even suffice for the purpose.

In the embodiment shown in FIG. 4, the probe 31 is not placed on the edge of the pane as is best for the detection of a break-in, but at a certain distance from the pane. In this case the probe 31 will be preferably connected to the pick-up 4 by a shielded cable 12 with a dielectric sheathing, preferably made of a PVC; this cable may even be comparatively long without entailing any particular disadvantage. The numeral 14 identifies the output cable of the probe.

It will be noted that for this application it is unnecessary to adjust with particular precision the sensitivity of the circuits which process the signals. The alarm will still be triggered through a contact, but it reacts to very weak disturbances (such as touching the pane with a finger, for instance). Actually, the system reacts when the electrostatic state of the entire assembly (pane-pick-up) is destabilized, which happens unfailingly when an object or a living being approaches the assembly, moves in the vicinity of the same, or when an object is lifted from the pane on which it rests.

FIGS. 5 to 8 schematically show circuits for amplifying and processing the signals emitted by the pickup. The system described here works with a threshold, in order to ensure that given an initial adjustment which is predetermined and does not change in the course of time, an alarm is only given when either the pane or its frame is subjected to a mechanical stress having sufficient energy to seriously endanger the glass pane, even if the same is not broken on the first attempt. One thus avoids the occurrence of untimely alarms triggered by "ordinary" stresses.

Figure 5:
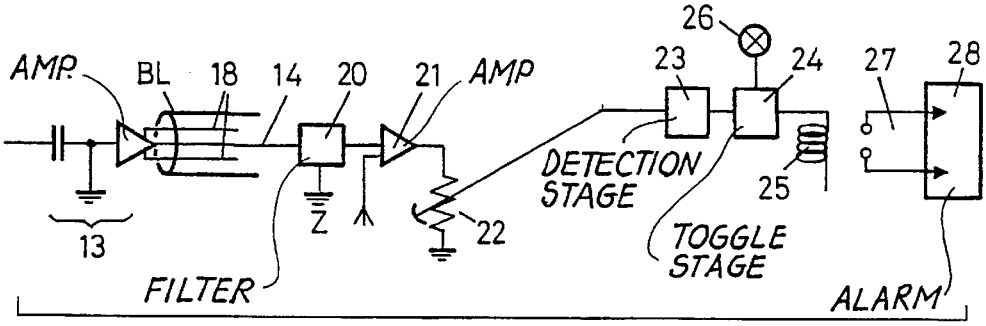
FIG. 5 is a schematic diagram of a circuit for amplifying and processing the signals issued by the pick-up.

FIG. 5 schematically shows the main electronic components for the protection of a single pane with a moderate surface. Numeral 13 in this figure designates the sensing assembly. This assembly 13 is connected a signal processing unit through an output conductor with a shielding BL, conductors 18 for the amplifier, and an output conductor 14 of the latter. The signal processing unit comprises a rejection filter 20, intended for instance for a band around 50 Hz, an amplifier-adaptor stage 21 and a sensitivity or threshold adjuster 22. These circuits are followed by a detection stage 23, a toggle stage 24 with a threshold adjustment and which acts on an output relay 25 with a control light 26. Finally, an output 27 is available on the output tap of the processing unit, in order to command the alarm installation 28 which is illustrated schematically. This installation may contain the necessary power sources and be adequately protected.

Figure 6:
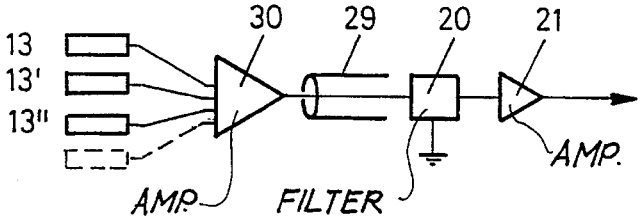
FIG. 6 schematically shows how several signals issued by different pick-ups are grouped together.

FIG. 6 shows partially the same circuits as FIG. 5, but in the case where signals issued by several sensing assemblies 13, 13', 13" are grouped together by means of an amplifier 30 with several inputs, and then transmitted to the rejection filter 20, through a unique channel 29. The pick-ups can be placed on a single pane or on several panes.

Figure 7:
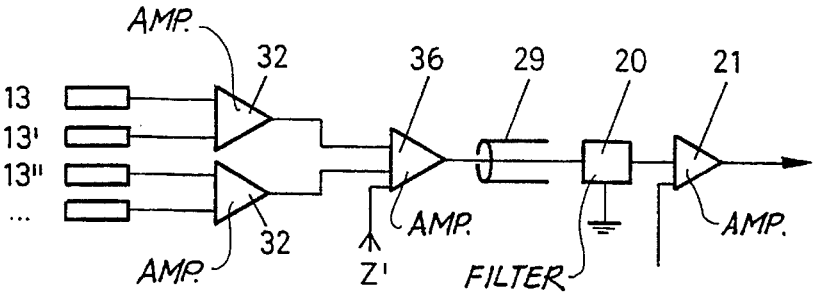
FIG. 7 shows a two by two grouping of signals issued by different pick-ups.

If one wishes to avoid false alarms in protection systems against break-in, an additional method for neutralizing possible effects of perturbations which affect an entire building consists in a coupling of the panes through different systems. This is illustrated in FIG. 7, in which the signals issued by two glass panes (or two sensing assemblies placed at different locations of one and the same pane) are merged two by two with the help of two differential amplifiers 32, the output signals of which are themselves merged by means of an adjustable differential amplifier 36. Such mergings, which may be weighted if necessary, can be very useful in circumstances where there are many stray vibrations, although the pick-ups are very insensitive to vibrations of the ground, especially if they are placed vertically along the side edges of vertical panes.

Figure 8:
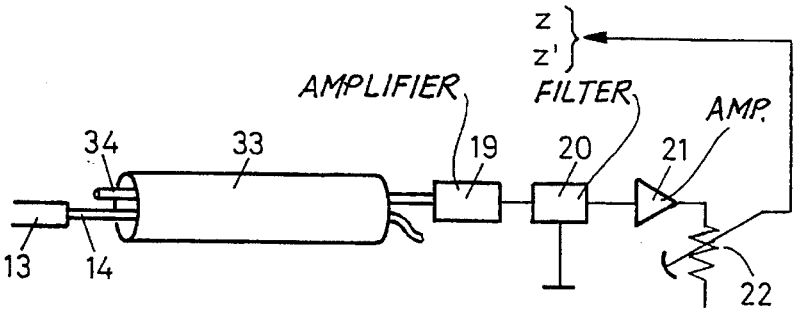
FIG. 8 schematically shows a method for protecting the conductors which connect the probe with the alarm circuit.

FIG. 8 shows how the conductors connecting the sensing assembly 13 with the electronic processing circuits may be protected. The output conductor 14 of the sensing assembly is placed in a protection tube 33. The tube itself can be protected against an attack from inside in such a way that it triggers the same alarm as if the panes were attacked. To this end, one can use a dummy connector 34 which is for instance provided with a sheath made of PVDF which induces a relative piezoelectrical effect when the tube is attacked. One and the same cable can be used for the entire assembly, and it will then protect all sheathes of the transmission connectors of a sector. At the output side of the tube 33 the same elements appear as in FIG. 5, to wit an electrometric amplifier 19, a rejection filter 20, and an amplifier-adaptor 21, the output signal of which is either transmitted to Z (FIG. 5), or to Z' (FIG. 7) after it has passed the threshold adjuster 22.

Apart from the elements which have been described, a complete protection installation will comprise an alarm station of the usual type. The station will be commanded by output contacts of relays of the signal processing unit, and may comprise any type of alarm-producing device, generally commanded through a power relay. Acoustical or optical signals can be produced, and one may even activate iron railings, gratings or other closing means.

The power circuits will preferably be placed within the alarm station. In general, a low power, permanent source will be used (buffer battery plus oscillator) and fed through an insulating transformer connected to the mains. If the mains fails, this triggers a warning signal.

Finally, if the control station is very far away, one can consider a wireless transmission. In this case the output relays which terminate the transfer elements (see FIG. 5) will activate miniaturized radio emitters of a known type, which are adapted to each particular assembly. The alarm station is then activated by wireless receivers which command output relays intended to make a contact which will command the same processes as the corresponding contact of the transmission element used in the case of a fully wired assembly.

While there are shown and described present preferred embodiments of the invention, it is to be distinctly understood that the invention is not limited thereto, but may be otherwise variously embodied and practiced within the scope of the following claims.

We claim:

1. Alarm device for monitoring a space which is bounded at least on one side by a surface barrier, said alarm device comprising at least one pick-up in the form of a condenser having a piezoelectric dielectric, said condenser being fastened to said barrier, said barrier having a rim around a periphery of the barrier, said condenser being rigidly fastened along the rim of the barrier, on at least a part of said periphery thereof, said barrier having a slit in an edge of the rim of the barrier, said condenser being fastened in said slit.

2. Device according to claim 1, wherein the barrier consists of a single or multiple-ply glass pane.

3. Device according to claim 2, wherein said condenser comprises superposed thin film layers deposited on the glass pane.

4. Alarm device for monitoring a space which is bounded at least on one side by a surface barrier, said alarm device comprising at least one pick-up in the form of a condenser having a piezoelectric dielectric, said condenser being fastened to said barrier, said barrier having a rim around a periphery of the barrier, said condenser comprising a U-shaped outer electrode including substantially parallel legs, said legs having inner surfaces, said piezoelectric material being lined on said inner surfaces of at least a part of said legs, and a central electrode inserted between said legs in contact with said piezoelectric material.

5. Device according to claim 4, wherein said central electrode has essentially the shape of a ribbon oriented parallel to the legs of the U-shaped outer electrode.

6. Device according to claim 4, wherein the legs of the U-shaped outer electrode point outwardly towards the periphery of the barrier.

7. Device according to claim 4, wherein the legs of the U-shaped outer electrode point inwardly away from the periphery of the barrier, portions of said central electrode protruding beyond the inner surface of said legs of the outer electrode.

8. Device according to claim 7, wherein said barrier comprises an insulating layer placed between the space being monitored and the condenser, said insulating layer having a surface facing the condenser which is at least partially covered by a conductor which forms a collector and is separated from the condenser by an insulating material.

9. Device according to claim 4, further comprising a probe connected to said condenser, said probe comprising an electrometric amplifier having an output connected to an electronic processing unit.

10. Device according to claim 9, wherein said probe is rigidly fastened to the barrier.

11. Device according to claim 9, wherein said processing unit comprises a stopband filter for passing portions of said amplifier output which are in a frequency band including 50 Hz, an amplifier stage, a sensitivity adjuster, a toggle circuit with an adjustable threshold, and an outlet for emitting output signals which command an alarm circuit.

12. Device according to claim 9, wherein a plurality of said pick-ups are connected to said processing unit through at least one differential amplifier to suppress undesired alarms due to vibrations.

13. Device according to claim 9, wherein said processing unit is adjustable to detect when the barrier is subjected to mechanical stresses of a certain intensity.

14. Device according to claim 9, wherein said probe is constructed to detect movements of dielectric objects within the space being monitored.

15. Device according to claim 14, wherein said barrier is surrounded at least over part of the periphery thereof by a border made of said dielectric material.

* * * * *